US005208426A

United States Patent [19]

Kennedy et al.

[11] Patent Number: 5,208,426

[45] Date of Patent: May 4, 1993

[54] SHIELDED ELECTRIC SIGNAL CABLE HAVING A TWO-LAYER SEMICONDUCTOR JACKET

[75] Inventors: Francis A. Kennedy, Elkton, Md.; John T. Mongan, Avondale, Pa.; William G. Hardie, Newark, Del.

[73] Assignee: W. L. Gore & Associates, Inc., Newark, Del.

[21] Appl. No.: 753,779

[22] Filed: Sep. 3, 1991

[51] Int. Cl.[5] ..... H01B 7/34

[52] U.S. Cl. ..... 174/36; 174/102 SC; 174/106 SC; 174/108; 174/109

[58] Field of Search ..... 174/36, 106 R, 106 SC, 174/102 SC, 108, 109

[56] References Cited

U.S. PATENT DOCUMENTS

| | | | |
|---|---|---|---|
| 2,397,082 | 3/1946 | Barker | 174/106 SC |
| 4,327,246 | 4/1982 | Kincaid | 174/36 |
| 4,347,487 | 8/1982 | Martin | 174/36 X |
| 4,638,114 | 1/1987 | Mori | 174/36 |
| 4,785,138 | 11/1988 | Breitenbach et al. | 174/106 SC |
| 4,986,372 | 1/1991 | Ganssle | 174/106 SC |
| 5,037,999 | 8/1991 | Van Deusen | 174/36 |
| 5,107,076 | 4/1992 | Bullock et al. | 174/36 X |

*Primary Examiner*—Morris H. Nimmo
*Attorney, Agent, or Firm*—Gary A. Samuels

[57] ABSTRACT

A shielded electric signal cable having at least two semiconductive jacket layers of the same or differing conductivity to cover pinholes, meet variable electrical resistance specifications, and decrease signal transfer from jacket to shield.

11 Claims, 2 Drawing Sheets

SHIELDED ELECTRIC SIGNAL CABLE HAVING A TWO-LAYER SEMICONDUCTOR JACKET

FIELD OF THE INVENTION

The invention relates to electric signal cables which are shielded with a layer of conductive shielding and a protective semiconductive jacket.

BACKGROUND OF THE INVENTION

Presently, twin-lead and tri-lead electric signal cables have an insulated conductor and at least one conductive drain wire. Around them is a shielding layer of helically-wrapped or longitudinally folded metal-coated polymer tape, metal foil tape, polymer tape filled with conductive materials, inherently conductive polymer tape, polymer tape having a conductive layer coated on each side which differ in composition, wire braid, or served wire. All this is jacketed with a single layer of jacket material, commonly of about 6 mil semiconductive insulation which may typically comprise, but is not limited to, conductive polyvinyl chloride (PVC) perfluoroalkoxy tetrafluoroethylene (PFA), copolymers of ethylene and tetrafluoroethylene (Tefzel), or polyvinylidene fluoride (Kynar) for example. Pinholes in the semiconductive jacketing occur in and are problems in these cables in that the pinholes are difficult to test for, owing to the semiconductive nature of the jacket material and are very difficult and expensive to correct when found. The present invention provides a unique and effective solution to these problems.

SUMMARY OF THE INVENTION

The invention comprises an electric signal cable having an insulated conductor and at least one conductive drain wire surrounded as a unit by a shielding layer preferably of helically-wrapped or longitudinally folded conductive tape, metal-coated polymer tape, metal foil tape, polymer tape filled with conductive materials, inherently conductive polymer tape, polymer tape having a conductive layer coated on each side which differ in composition, a braided or served wire, or combination thereof. Where the shielding layer is braided or served wire, a drain wire may not necessarily be present or advantageous. The shielded cable core is jacketed with two-layers of semiconductive polymer of the same conductivity or one of the layers may be either more or less conductive than the other. The more conductive layer can be arranged either on the inside or outside and may comprise different polymer materials. The semiconductive jacketing typically comprises two layers having together about the same thickness as the single jacket layers customarily used previously, such as two 3 mil layers instead of one 6 mil layer, for example. Two layers of semiconductive jacketing are advantageous in that there is far less chance of two pinholes in the conductive layers lining up and thus providing a gap in the jacket of the cable which could let fluid enter the cable or permit shorting of the shield to other parts of the system.

An embodiment of the cable of the invention wherein the outer jacket layer is less conductive than the inner jacket layer will not tend to short out the cable if it accidently fell across a power source, for example. An embodiment wherein the more conductive of the two semiconductive jacket layers is on the outside of the cable will have improved static electrical charge dissipation if such a charge occurred on the cable. There will also be less chance for any electric signal picked up on the jacket to be transferred to the shield of the cable.

DETAILED DESCRIPTION OF THE INVENTION

The invention is now described in detail in terms of the drawings to more clearly delineate the scope of the invention.

Figure 1:
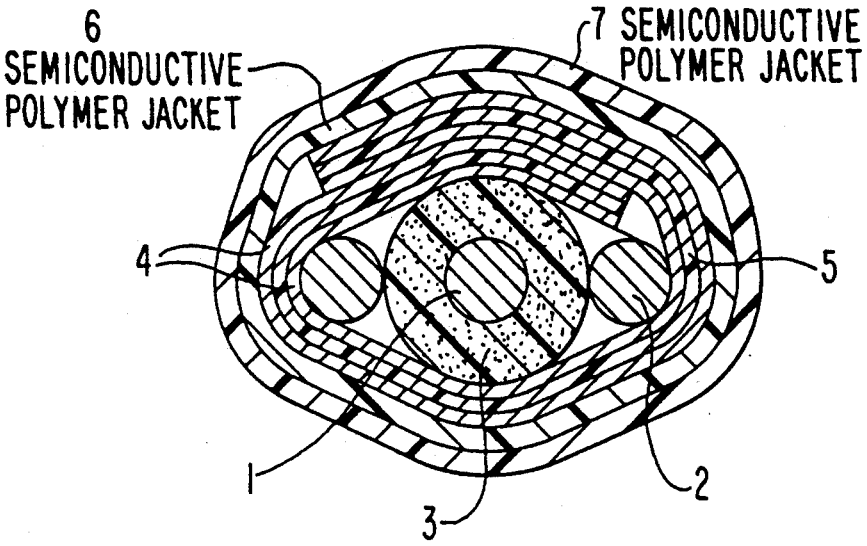
FIG. 1 is a cross-sectional view of a cable of the invention in which shielding is provided by a polymer tape coated on each side with a conductive metal.

FIG. 1 shows a cross-sectional view of a cable of the invention in which a signal-carrying center conductor 1 is surrounded by primary insulation 3 and flanked on two sides by conductive drain wires 2 which parallel or are spiralled around the insulated signal conductor along the length of the cable. Alternatively, only one drain wire or more than two drain wires could be used. The center conductor 1 and drain wires 2 are of conductive metals customarily used in the cable art, such as copper, copper alloys, silver or other noble metal plated copper, iron or steel, or aluminum, for example. Primary insulation 3 may be any insulative polymer material, but is preferably a porous insulation, and most preferably expanded polytetrafluoroethylene (PTFE), such as that disclosed in U.S. Pat. Nos. 3,953,566, 3,962,153, 4,096,227, 4,187,390, 4,902,423 or 4,478,665, assigned to W. L. Gore & Associates, Inc. Polyethylene, polypropylene, fluorocarbons, polyvinyl chloride, polyurethane, and rubber are exemplary of those insulations customarily used for such purposes, as are foamed versions of the polymers listed above which have improved electrical properties and reduced density.

Figure 2:
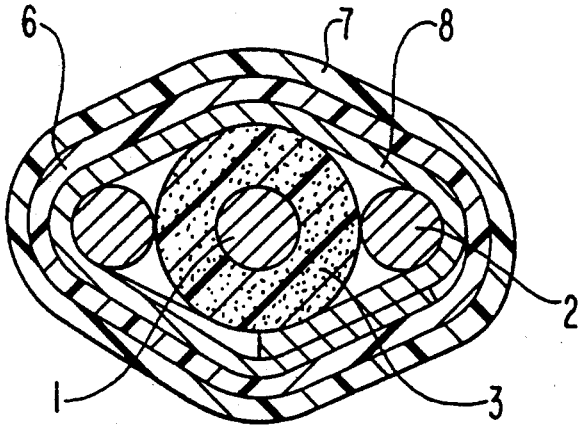
FIG. 2 is a cross-sectional view of a cable of the invention in which shielding is provided by a conductive layer.

The cable core, comprising center conductor 1 surrounded by insulation 3, and including the drain wires 2, if present, is surrounded by a layer of helically-wrapped or longitudinally folded conductive tape or a layer of served or braided wires which serve to electrically shield the core of the cable and its signal conductor 1. The shielding tape may comprise a polymer tape 5 coated on both sides with an electrically conductive metal 4 or may comprise a conductive shielding material 8 as illustrated in FIG. 2, such as a metal tape, and may also comprise a polymer tape filled with conductive materials, inherently conductive polymer tape, a polymer tape having a conductive layer coated on each side which differ in composition, or a served or braided wire.

The polymer tape 5 may comprise any useful polymer material with polyethylene, polypropylene, polyester, polyimide, or fluorocarbon being preferred, and polyester tape is most preferred. Tape 5 is coated on both sides with a layer of conductive metal 4, such as aluminum, copper, copper alloys, or the like by methods of electroplating, vapor deposition, sputtering, or any other useful and customary method for metal-coating polymer films and tapes. Tape 5 may be substituted by a conductively filled or inherently conductive polymer material.

Alternatively, foil wire, or flattened wire can be used as a shielding layer to make shielded cable core.

Surrounding the shielding around the core of the cable are two thin layers 6 and 7 of semiconductive polymer which may be extruded or tape-wrapped helically or longitudinally folded around the shielded core to form the outer protective jacket of the cable. Useful polymers for the jacket may include but are not limited to semiconductive forms of PVC, PFA, Tefzel, Kynar, polyurethane, PTFE, or other thermoplastic fluorocarbons, for example. Any useful conductive material may be used to render the above polymers semiconductive, with conductive carbon being preferred. Layers 6 and 7 are very thin and may be of differing electrical conductivity with it being useful in meeting product specifications, such as for concentricity, jacket-to-shield resistance, or down tube resistance, to arrange that the outer jacket layer 7 be either more or less conductive than inner jacket layer 6 to favor the optimization of the specified property being sought thereby.

FIG. 2 describes in a cross-sectional view an alternate embodiment of the cable wherein an electrically conductive shielding material 8 is wrapped around the cable core and drain wires 2 to provide a shielding layer. Material 8 can be a metal tape, a polymer tape filled or coated with a conductive material, an inherently conductive polymer tape, or served or braided wire. Other layers are the same as those described in FIG. 1.

Figure 3:
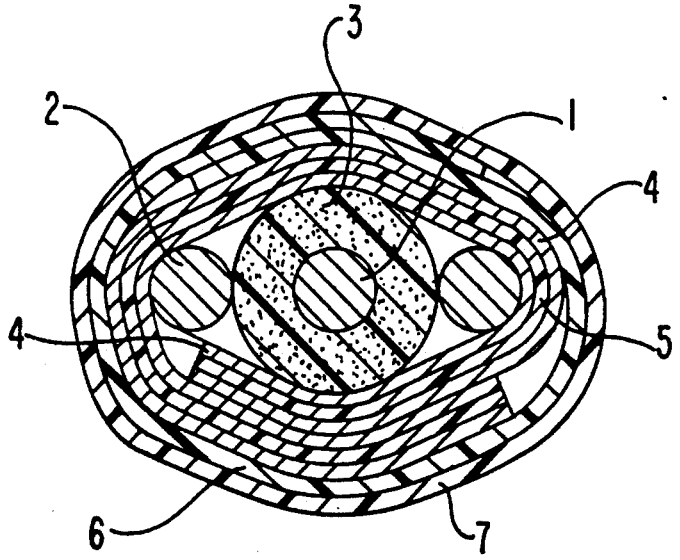
FIG. 3 is a cross-sectional view of a cable in which shielding is provided by a polymer tape coated on each side with a conductive metal, a spiralled tape polymer inner jacket, and an extruded polymer outer jacket.

FIG. 3 describes in a cross-sectional view an alternative embodiment of the cable wherein inner jacket layer 6 is spirally wrapped around the cable core and outer jacket layer 7 is extruded around wrapped layer 6. This arrangement allows non-extrudable materials to be used in layer 6.

One may also use different polymer materials in layers 6 and 7, such as economically pairing a cheaper semiconductive polyolefin inner layer with a more expensive semiconductive fluorocarbon outer layer, or a PVC inner layer with a PFA outer layer to control plasticizer loss from the PVC layer.

We claim:

1. A shielded electric signal cable comprising from inside to outside:

(a) a conductive metal center conductor surrounded by an electrically insulating material;

(b) at least one electrically conductive metal drain wire positioned along the length of said cable outside of said insulating material;

(c) a layer of electrically conductive shielding material positioned around said center conductor, said insulating material, and said drain wires as a unit; and (d) at least two layers of semiconductive polymer jacketing surrounding the shielding material.

2. A cable of claim 1 wherein the layers of at least two layers of the semiconductive polymer jacketing have different electrical conductivities.

3. A cable of claims 1 or 2, wherein said insulating material comprises expanded polytetrafluoroethylene.

4. A cable of claim 1, wherein said shielding material is selected from the group consisting of metal tape, conductively-filled polymer tape, inherently conductive polymer tape, and polymer tape having conductive layers coated on each side which are of different conductivity.

5. A cable of claims 1 or 2, wherein said semiconductive polymer jacketing includes at least one layer of thermoplastic fluorocarbon.

6. A shielded electric signal cable comprising from inside to outside:

(a) a conductive metal center conductor surrounded by an electrically insulating material;

(b) at least one electrically conductive metal drain wire positioned along the length of said cable outside of said insulating material;

(c) a layer of polymer tape coated on both sides with an electrically conductive metal wrapped around said center conductor, said insulation, and said drain wires as a unit; and (d) at least two layers of semiconductive polymer jacketing surrounding the layer of polymer tape.

7. A cable of claim 6, wherein said insulating material comprises expanded polytetrafluoroethylene.

8. A cable of claim 7, wherein said polymer tape comprises thermoplastic polyester and said metal coated thereon comprises aluminum.

9. A cable of claim 8, wherein said semiconductive polymer jacketing includes at least one layer of thermoplastic fluorocarbon.

10. A shielded electric signal cable comprising from inside to outside:

(a) a conductive metal center conductor surrounded by an electrically insulating material;

(b) a shielding layer comprising metal wires around said center conductor and said insulating material as a unit; and (c) at least two layers of semiconductive polymer jacketing.

11. A cable of claim 10 wherein said shielding layer wires are served, spiralled or braided around said unit.

* * * * *